US007017259B2

(12) United States Patent
Aoki

(10) Patent No.: US 7,017,259 B2
(45) Date of Patent: Mar. 28, 2006

(54) HOUSING REMOVAL TOOL

(75) Inventor: Fumio Aoki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/739,779

(22) Filed: Dec. 18, 2003

(65) Prior Publication Data

US 2004/0192086 A1 Sep. 30, 2004

Related U.S. Application Data

(62) Division of application No. 10/055,564, filed on Jan. 23, 2002, now abandoned.

(30) Foreign Application Priority Data

Sep. 6, 2001 (JP) ..... 2001-270966

(51) Int. Cl.
*H01R 43/00* (2006.01)

(52) U.S. Cl. ..... 29/739; 29/747; 29/758; 29/845; 29/884

(58) Field of Classification Search ..... 29/739, 29/740, 741, 747, 758, 764, 762, 278, 842, 29/845, 884
See application file for complete search history.

(56) References Cited

U.S. PATENT DOCUMENTS

| | | | | |
|---|---|---|---|---|
| 3,443,297 | A * | 5/1969 | Lusby, Jr. | 29/764 |
| 4,008,939 | A * | 2/1977 | Kinkaid et al. | 439/264 |
| 4,583,287 | A * | 4/1986 | McDevitt et al. | 29/741 |
| 5,094,634 | A | 3/1992 | Dixon et al. | |
| 5,208,968 | A * | 5/1993 | Camsell et al. | 29/739 |
| 5,797,177 | A * | 8/1998 | Simmons et al. | 29/739 |

* cited by examiner

*Primary Examiner*—Minh Trinh
(74) *Attorney, Agent, or Firm*—Katten Muchin Rosenman LLP

(57) ABSTRACT

A housing-remover tool for a press-fit connector. The tool including shoulder part pressers for pressing the shoulder parts of pin-shaped terminals, each shoulder part presser having a hollow part for receiving a pin part of the pin-shaped terminal and a cut-away part at a leading end for engaging with the shoulder part; a first sub-assembly for insertion inside a housing of the connector and provided with through-holes for receiving the shoulder part pressers; and a second sub-assembly having a pair of engagement members having engaging protrusions which can engage with stepped parts of the housing and a lifting portion for lifting the engagement members along the side surfaces of the first sub-assembly.

6 Claims, 19 Drawing Sheets

85
86
87
33
31
28
32
34

HOUSING REMOVAL TOOL

This application is a divisional of U.S. patent application 10/055,564, filed Jan. 23, 2002, now abandoned.

BACKGROUND OF THE INVENTION

1. Field of the Invention

The present invention relates to a press-fit connector which can be connected to a circuit board such as a printed wiring board, and particularly relates to a press-fit connector enabling replacement and repairs of individual defective terminal or of a housing and a housing-remover tool for such a connector.

A rapid development in a connector known as a press-fit type used for an electronic apparatus or a communication apparatus has resulted in a finer pitch of pin-type terminal array and an increased number of terminals. Due to reduced diameter of pin parts of the pin-type terminals, a slight external force applied during processes such as press-fitting the connector to the circuit board, connecting the connectors and handling the connectors may cause various defects such as buckling, bending or breaking of the pin-type terminals.

In order to deal with such defects, it is often required to remove the connector from the circuit board. However, such a defect may arise during manufacturing of an electronic apparatus and also while such an apparatus is in operation. Therefore, there is a need for a connector enabling easy repairs and a tool for such repairs.

FIG. 1 is a diagram showing a general press-fit connector. A housing 1 is made of molded synthetic resin member and has a rectangular cross-section when viewed from the front. Pin-type terminals 5 are forced into a plurality of terminal through-holes 3 provided in a bottom surface 2 of the housing 1. Also, stepped parts 6 are provided in parallel on a pair of opposing edges of the bottom surface of the housing 1.

The pin-type terminals 5 are made of a metal such as phosphor bronze having high conductivity, mechanical strength and elasticity. The pin-type terminal 5 has pin parts 7 of small diameters at both ends in a vertical direction shown in the Figure, a shoulder part 8 provided at an intermediate part and having a great width, and press-fit part 9 formed as a ship bottom shape by a pressing process. The pin-type terminal is for example Au-plated and is secured to the housing 1 by forcing the shoulder part 8 into the terminal through-hole 3.

The circuit board 11 which may include a printed wiring board is provided with through-holes 13 formed at positions corresponding to the pin-type terminals 5. The conductive coating 12 is applied in the through-holes 13. When the press fit part 9 is inserted in to the through-hole 13, both sides of the bottom ship shape deforms in an elastically-compressed manner. The press fit part 9 elastically touches the conductive coating 12 by a recovering force to realize an electric connection. The conductive coating 12 is connected to a circuit pattern (not shown) of the circuit board 11. FIG. 1 shows a state just before the press-fit part 9 is inserted into the through-hole 13.

2. Description of the Related Art

FIGS. 2A and 2B are a plan-view and a transverse cross-sectional view in which it is insertion connected to the circuit board 11, respectively, of a connector. As can be shown in the figures, the shoulder parts 8 of the pin-type terminals 5 and the longitudinal direction of the press-fit part 9 align with the longitudinal direction of the housing 1, but is shown in an orthogonal direction in FIG. 1 for convenience of the description. Also, the pin parts 7 on the lower side of the pin-type terminals 5 are shown to be shorter than the upper pin part 7.

As shown in FIG. 3A, which is an enlarged view of a main part of the terminal through-hole 3 of the housing, the terminal through-hole 3 has a rectangular shape. Also, as shown in FIG. 3B, which is an enlarged view of a main part of the pin-type terminal 5, the shoulder part 8 has a rectangular cross-section extending in a vertical direction of the figure. The pin part 7 having a square shape is positioned at the center thereof and the shoulder part 8 is configured such that its thickness (the horizontal direction in the figure) and its width the vertical direction in the figure) are greater than those of the terminal through-hole 3. Accordingly, the pin 5 is secured in the terminal through-hole 3 after being forced therein.

FIG. 4 is a cross-sectional diagram showing various possible defections of the connector. In the figure, "A" shows a state where the pin-type terminal 5 is bent by buckling of the press-fit part 9. "B" shows a normal state where there is no defection of the pin-type terminal 5. "C" shows a state where the pin part 7 of the pin-type terminal 5 is bent. "D" shows a state where the pin part 7 of the pin-type terminal 5 is broken. "E" shows a state where there is deformation or a defect at a part of the peripheral wall of the housing 1.

The state "A" may arise during a process of press-fitting the connector to the circuit board 11. The state "C" may arise when the mating connector 15 is inserted while there is an inclination of the pin-type terminal 5 in the stat shown in FIG. 2B. The state "D" may arise when attempting to pull and remove the connector from the state "C" and the bent part is cut. The state "E" may arise by improper handling of the connector. In practice, for the states "C" and "D", the bottom surface of the housing 1 is in contact with the surface of the circuit board 11. The state shown in FIG. 4 may arise due to various causes described above, but are illustrated in the same figure for the sake of convenience.

For the state "A" described above, the housing 1 must be pulled and removed since the bent press-fit part 9 is tucked between the housing 1 and the circuit board 11. However, in order to pull and remove the housing 1, other pin-type terminals 5 that are already press-fit to the circuit board 11 may also be pulled with the housing 1. This is due to the fact that the pin-type terminals 5 forced into the housing is held with a resistance force against a pulling force of approximately 10N per pin.

When the housing 1 is pulled by engaging some kind of a tool at hand to the stepped part 6, a secondary defection such as half pulled out state of other pin-type terminals 5 press-fit to the circuit board 11, deformation of the press-fit part 9, bend of the pin part 7.

In the state "C", if one attempts to pull the tip of the bent pin part 7 by clamping with a tapered pincher, the pin part 7 may be cut and give rise to the state "D". In the state "D", as has been described above, the housing 1 must be removed by clamping the shoulder part 8. Although it is possible to clamp the shoulder part 8, in removing the housing 1, there are problems as has been described above.

When dealing with the state "E", when one attempts to replace the housing 1 only, there are still various problems as described above.

From the foregoing, press-fitting of the connectors to an apparatus is feasible at the factory but is substantially difficult or impossible for an apparatus in operation since it eventually requires replacement with a new connector.

SUMMARY OF THE INVENTION

Accordingly, it is a general object of the present invention to provide a press-fit connector and a housing-remover tool for such a connector.

It is another and more specific object of the present invention to provide a press-fit connector having a structure such that defective terminal or the housing can be individually replaced or repaired and a housing-remover tool for such a connector.

In order to achieve the above object, a press-fit connector is provided which include:

a housing provided with a plurality of through-holes; and pins secured to the housing by forcing shoulder parts of the pins into the through-holes, wherein the through-holes are configured such that gaps are formed between the shoulder parts and inner walls of the through-holes.

Also, a housing-remover tool for a press-fit connector is provided, which includes;

shoulder part pressers for pressing the shoulder parts of the pin-shaped terminals, the shoulder part presser having a hollow part for receiving a pin part of the pin-shaped terminal and a cut-away part at a leading end for engaging with the shoulder part;

a first sub-assembly which can be inserted inside a housing of the connector and provided with through-holes for receiving the shoulder part pressers; and a second sub-assembly having a pair of engagement members having engaging protrusions which can engage with the stepped parts of the housing and lifting means for lifting the engagement members along the side surfaces of the first sub-assembly.

With such a press-fit connector and a housing-remover tool for such a connector, non-defective pin-type terminals inserted to the circuit board are prevented from being extracted. Therefore, since the housing of the connector can be removed in a positive and easy manner, the pin-shaped terminals can be replaced and repaired easily.

DETAILED DESCRIPTION OF THE PREFERRED EMBODIMENTS

Figure 1:
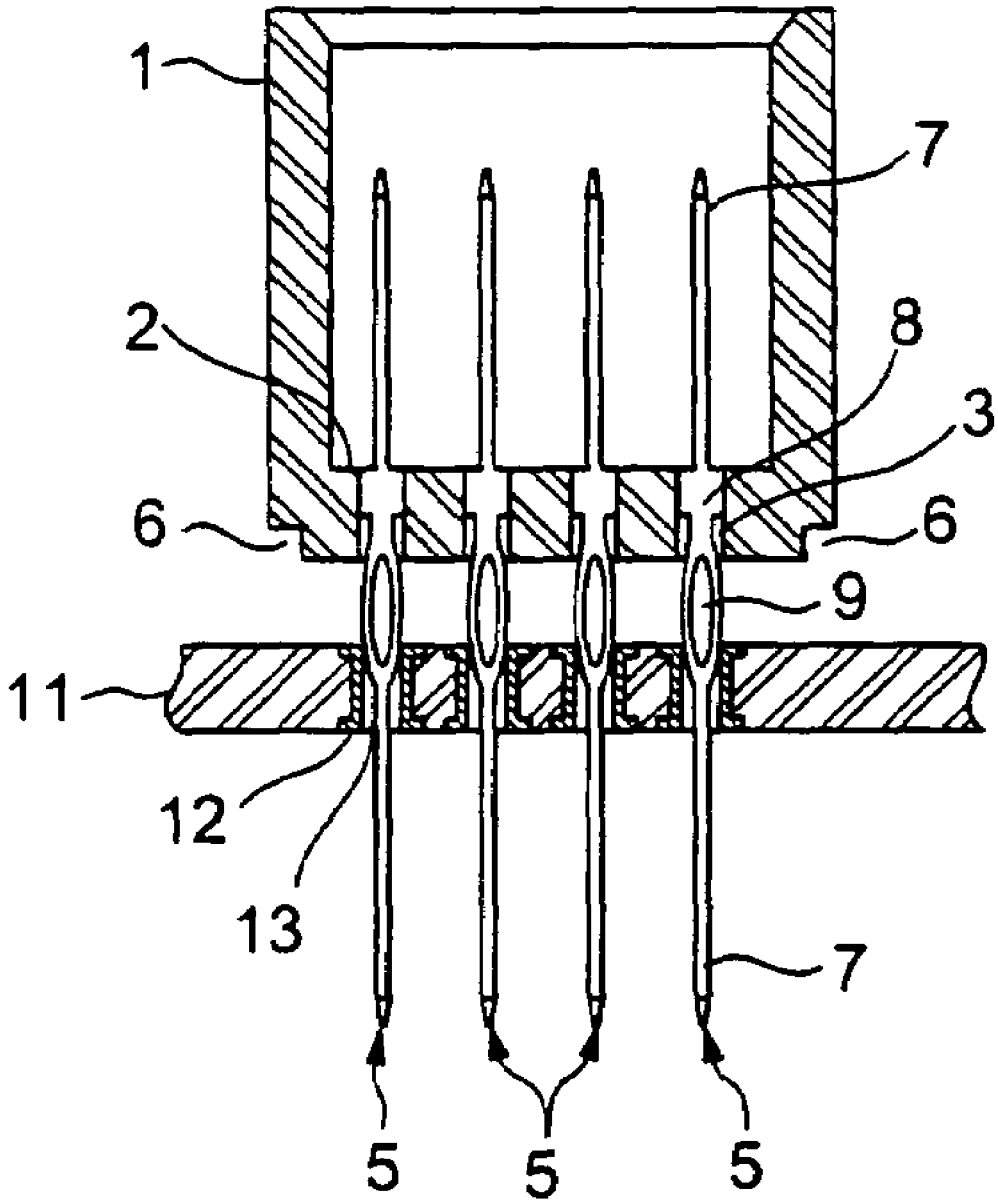
FIG.1 PRIOR ART
FIG. 1 is a schematic diagram showing a press-fit connector.
Figure 2A:
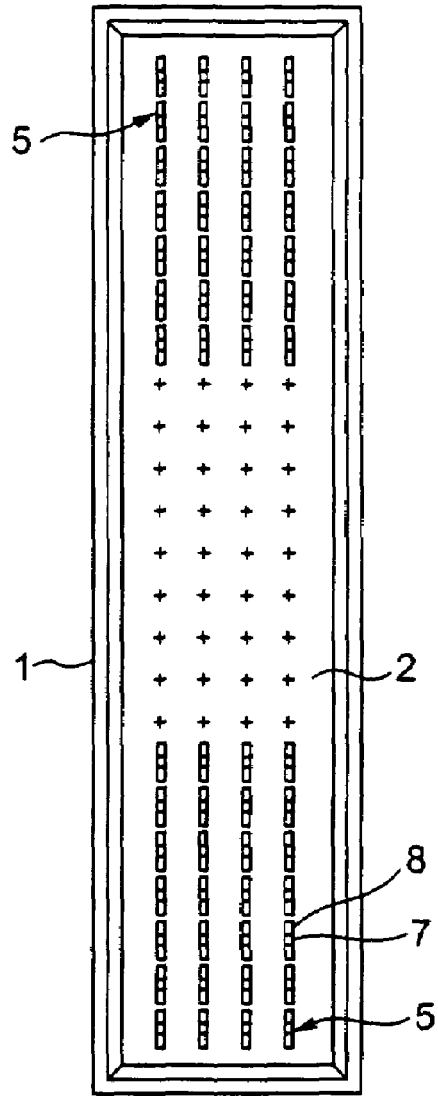
FIG.2A PRIOR ART
FIGS. 2A and 2B are a plan-view and a transverse cross-section view, respectively, showing a press-fit connector of the related art.
Figure 2B:
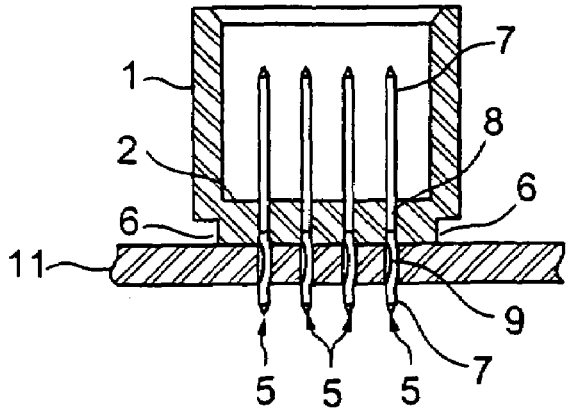
FIG.2B PRIOR ART
Figure 3A:
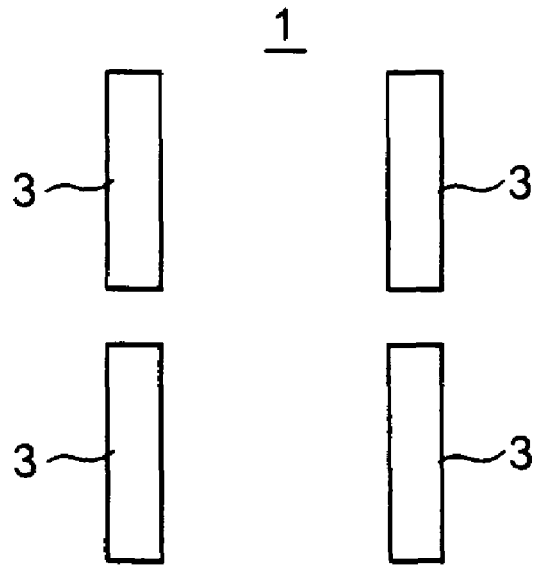
FIG.3A PRIOR ART
FIG. 3A is an enlarged view of a main part of the terminal through-hole of the housing and FIG. 3B is an enlarged view of a main part of the pin-type terminal of the relate art.
Figure 3B:
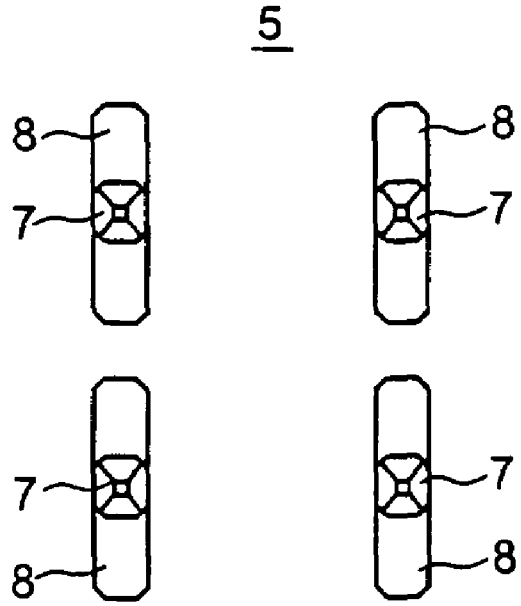
FIG.3B PRIOR ART

In the following, principles and embodiments of the present invention will be described with reference to the accompanying drawings.

Throughout the figures, similar elements are shown by similar reference numerals for better understanding.

Figure 5A:
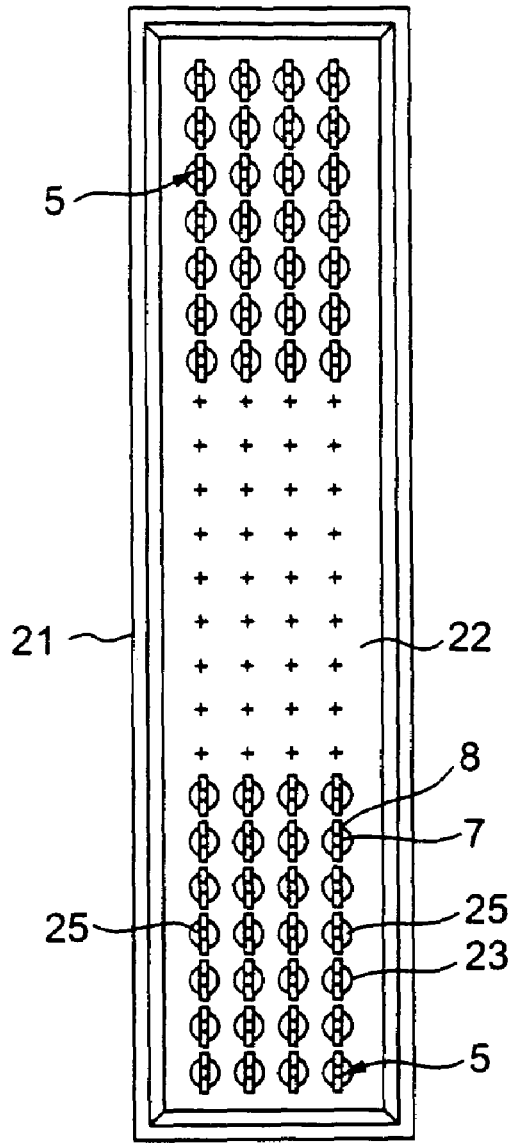
FIGS. 5A and 5B are schematic diagram showing a press-fit connector of the present invention.
Figure 5B:
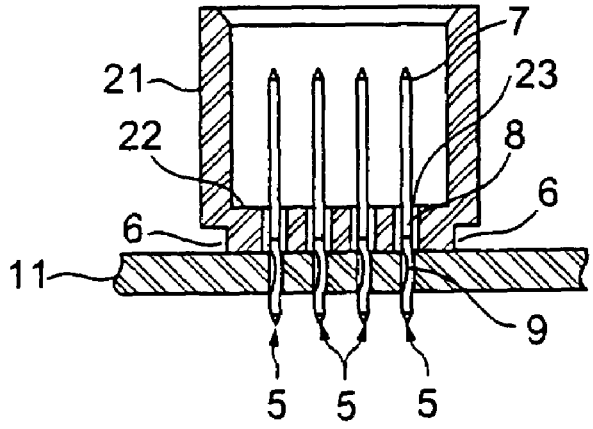

FIGS. 5A and 5B are diagram showing an embodiment of a press-fit connector according to the present invention. FIG. 5B is a cross-sectional diagram showing a connector in a state where it is press-fitted to a circuit board 11 such as a printed wiring board.

A housing 21 is made of molded synthetic resin member and is rectangular when viewed from the front. A plurality of pin-type terminals 5 are press-fitted in a plurality of terminal through-holes 23 provided in a bottom surface 22 of the housing 21. Also, stepped parts 6 are provided in parallel on a pair of opposing edges of the bottom surface of the housing 21.

The pin-type terminals 5 are made of a metal such as phosphor bronze having high conductivity, mechanical strength and elasticity. The pin-type terminal 5 has pin parts 7 of small diameters at both ends in a vertical direction shown in the Figure, a shoulder part 8 provided at an intermediate part and having a great width, and press-fit part 9 formed in a ship bottom shape by a pressing process. The terminal part is for example Au-plated and is held on the housing 1 by press-fitting the shoulder part 8 into the terminal through-hole 23.

The circuit board 11 which may include a printed wiring board is provided with through-holes 23, as has been described with reference to FIG. 1, formed at positions corresponding to the terminals pins 5 and whereto a conductive coating 22 is applied. When the press-fit part 9 is inserted into the through-hole 23, both edges of the bottom ship shape deforms in an elastically-compressed manner. The press fit part 9 elastically touches the conductive coating 22 by a recovering force so as to realize an electric connection. The conductive coating 22 is connected to a circuit pattern (not shown) of the circuit board 11.

Figure 6A:
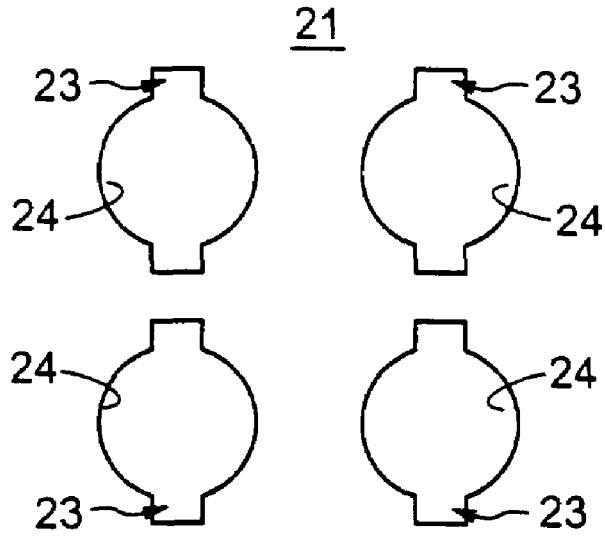
FIG. 6A is an enlarged view of a main part of the terminal through-hole of the housing and FIG. 6B is an enlarged view of a main part of the pin-type terminal of the present invention.

As shown in FIG. 6A, which is an enlarged view of a main part of the through-hole 23 of the housing, the through-hole 23 has a rectangular shape and is further provided with a circular through-hole part 24 at its central part.

Figure 6B:
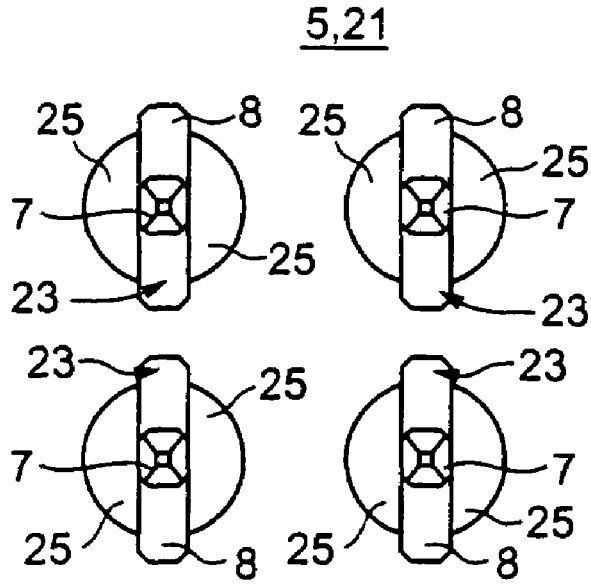
Figure 7B:
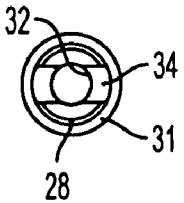
FIGS. 7A to 7D are diagrams showing a side view, a front end view, a rear end view and a cross-sectional view, respectively, of a shoulder part presser of the present invention.
Figure 7A:
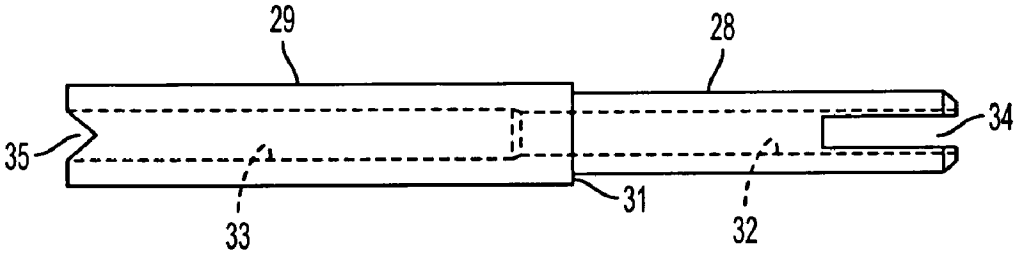
Figure 7C:
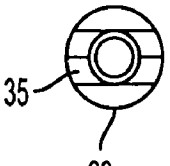
Figure 7D:
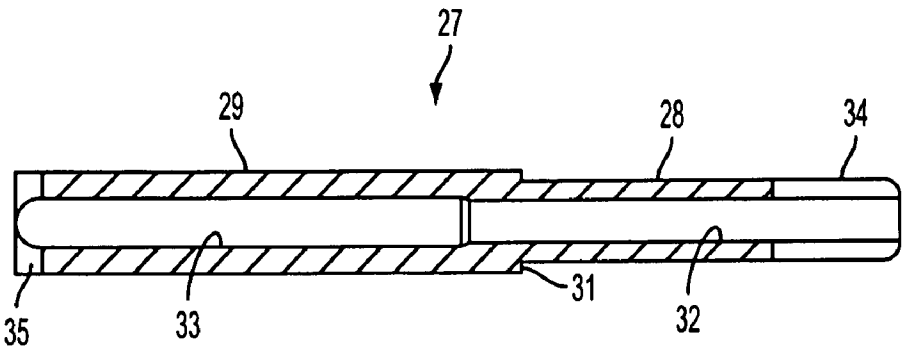

As shown in FIG. 6B, which is an enlarged view of a main part of the pin-type terminal 5, the shoulder part 8 has a rectangular cross-section extending in a vertical direction in the figure. The pin part 7 having a square shape is positioned at the center thereof and the shoulder part 8 is configured such that its thickness (the horizontal direction in the figure) and its width (the vertical direction in the figure) are greater than those of the terminal through-hole 23. Accordingly, the pin 5 is secured in the terminal through-hole 23 after being forced therein.

FIG. 6B shows a state where the shoulder part 8 is forced into the through-hole 23. Because of the circular through-hole part 24, gaps 25 are formed on both sides of the shoulder parts 8 at positions between the arcs of the circular through-holes 24 and the shoulder parts 8.

FIGS. 7A to 7D are diagrams showing a side view, a front end view, a rear end view and a cross-sectional view, respectively, of a shoulder part presser 27 of the present invention.

Figure 9B:
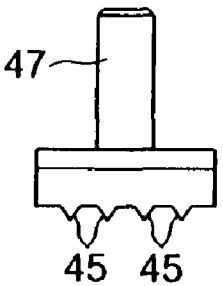
FIGS. 9A and 9B are a bottom plan view and a side view, respectively, of a lid member of a first subassembly of the housing-remover tool
Figure 9D:
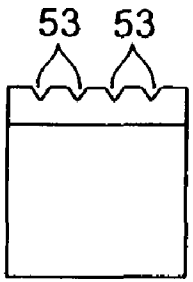
FIGS. 9C and 9D are a top plan view and a side view, respectively, of a main body of the first subassembly of the housing-remover tool.
Figure 9A:
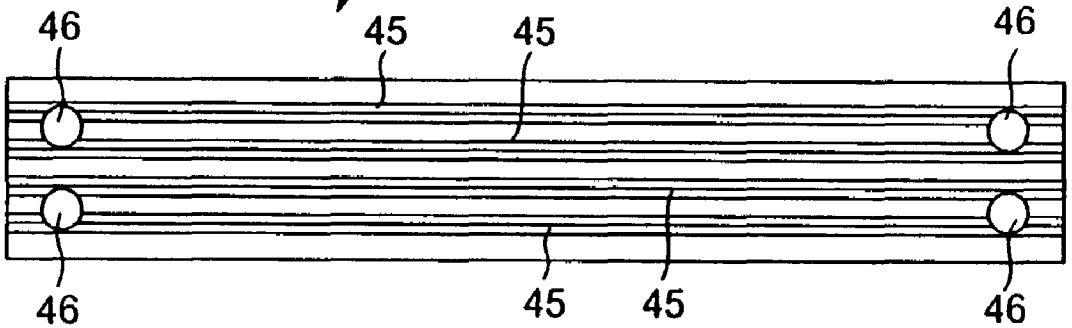
Figure 9C:
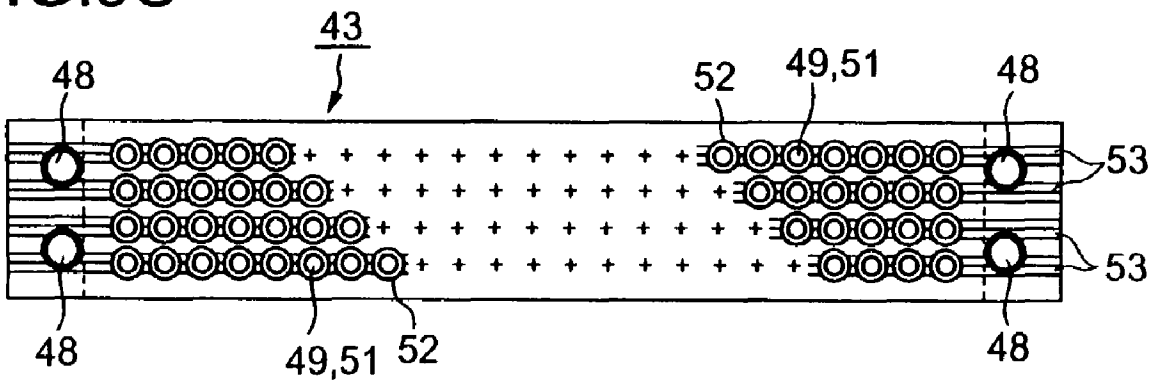

The shoulder part presser 27 is provided with a small-diameter cylinder part 28 at the leading end, a large-diameter cylinder part 29 at the rear end and a stepped part 31 at the boundary of the cylinder parts 28 and 29. A small-diameter hollow part 32 extending through the small-diameter cylinder part 28 and a large-diameter hollow part 33 extending through the large-diameter cylinder part 29 communicate at the center of the shoulder part presser 27. A cut-away part 34 parallel to the longitudinal direction of shoulder part presser 27 is provided at the leading end and a V-shaped notch 35 is provided at the rear end of the shoulder part presser 27. The cut-away part 34 and the notch 35 are cut in the same orientation. The shoulder part presser 27 is made of a metal material such as stainless steel FIGS. 9A and 9B are a bottom plan view and a side view, respectively, of a lid member of a first subassembly 41 of the housing-remover tool and FIGS. 9C and 9D are a top plan view and a side view, respectively, of a main body of the first subassembly 41 of the housing-remover tool.

The lid member 42 is provided with four ridges 45 extending in a horizontal direction of the figure on its lower surface, screw holes 46 at four corners and a shaft 47 provided at the central part of the top surface.

The main body 43 has a block shape with a thickness corresponding to the thickness of the lid member 42. The main body 43 is provided with screw holes 48 at four corners and a plurality of through-holes provided with a certain interval between four rows. The through-hole is provided with a small-diameter through-hole part 49 near the front surface and a large-diameter through-hole part 51 near the back surface and communicating the small-diameter through-hole part 49. A stepped part 52 is provided at the boundary of the small-diameter through-hole part 49 and the large-diameter through-hole part 51. The small-diameter through-hole part 49 and the large-diameter through-hole part 51 are configured to mate with the small-diameter cylinder part 28 and the large-diameter cylinder part 29 of the shoulder part presser 27. The positioning between the shoulder part presser 27 and the through-hole in the longitudinal direction of the shoulder part presser 27 is defined by the stepped part 31 of the shoulder part presser 27 and the stepped part 52 of the through-hole 52.

Further, on the top surface of the main body 43, grooves 53 having a V-shaped cross-section are formed in parallel so as to pass through each of the four rows of the through-holes. The grooves 53 are configured such that they mate with the ridges 45 of the lid member 42.

Figure 10C:
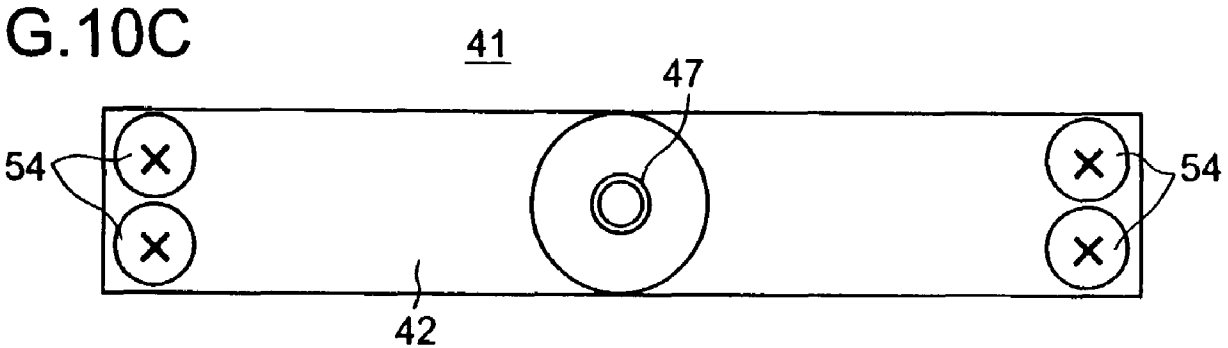
FIGS. 10A to 10C are a longitudinal cross-sectional view, a side view, and a top plan view, respectively, of the first sub-assembly of the housing-remover tool in a state where the shoulder part pressers 27 are assembled thereto.
Figure 10A:
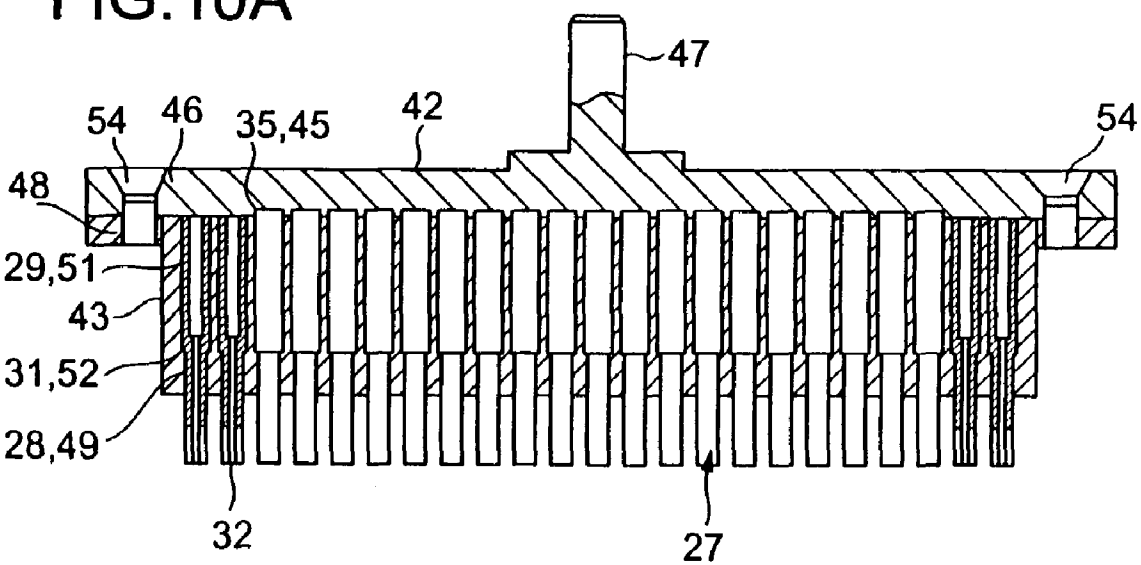
Figure 10B:
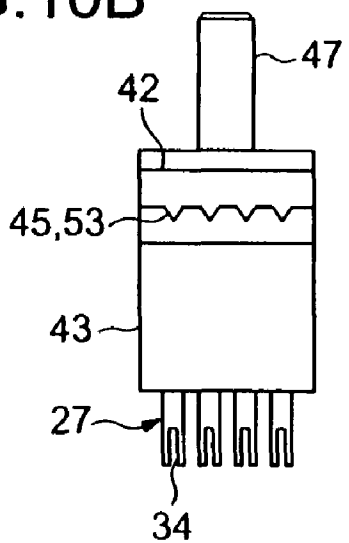

FIGS. 10A to 10C are a longitudinal cross-sectional view, a side view, and a top plan view, respectively, of the first sub-assembly 41 of the housing-remover tool in a state where the shoulder part pressers 27 are assembled thereto.

It is to be noted that FIG. 10A is a partial cross-sectional view in which some of the shoulder part pressers 27 are shown in cross-section, but other parts are not shown as a cross-section. Therefore, countersink screws 54 provided at both ends for joining the lid member 42 and the main part 43 can be seen in the figure.

In order to assemble the shoulder part presser 27 to the main part 43, firstly, the small-diameter cylinder part 28 is inserted to the large-diameter through-hole 51 from the top side of the main body 43. The shoulder part pressers 27 are positioned as shown in the figure due to the mutual sizing between the shoulder part pressers 27 and the through-holes. The stepped parts 31 and 52 define the positioning of the shoulder part presser 27 along its longitudinal direction as shown in the figure.

During or after the insertion process, all the V-shaped notches 35 of the shoulder part presser 27 should be aligned in the direction of rows. In this manner, when the lid member 42 is placed over the main body 43, the ridges 45 engage the grooves 53 and the V-shaped notches 35 of the shoulder part presser 27 as shown in the figure. Then, the countersink screws 54 are inserted into screw through-holes 46 of the lid member 42 and into the screw holes 48 of the main body 43. Thus, the lid member 42 and the main body 43 are joined together. Accordingly, all of the cut-away parts 34 of the shoulder part pressers 27 are aligned in the direction of rows.

Figure 11B:
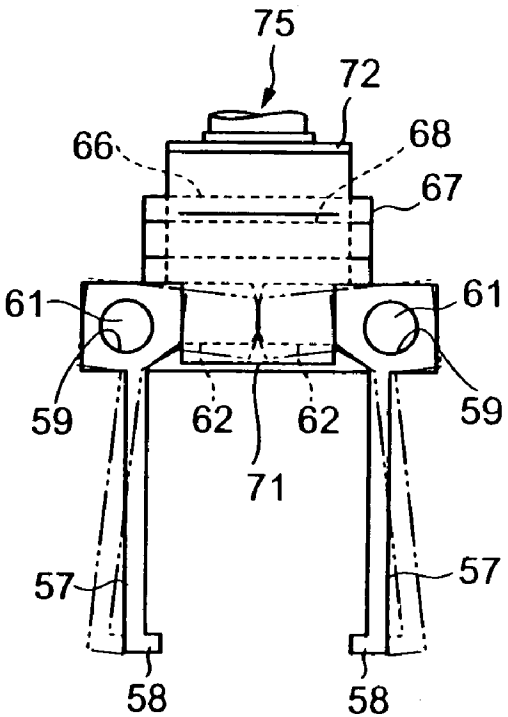
FIGS. 11A and 11B show a front view and a side view, respectively, of a second sub-assembly of the housing-remover tool having a pair of engagement members to engage with the first sub-assembly of the housing-remover tool shown in FIGS. 10A to 10D and pulling means for separating the engagement member from the first sub-assembly.
Figure 11A:
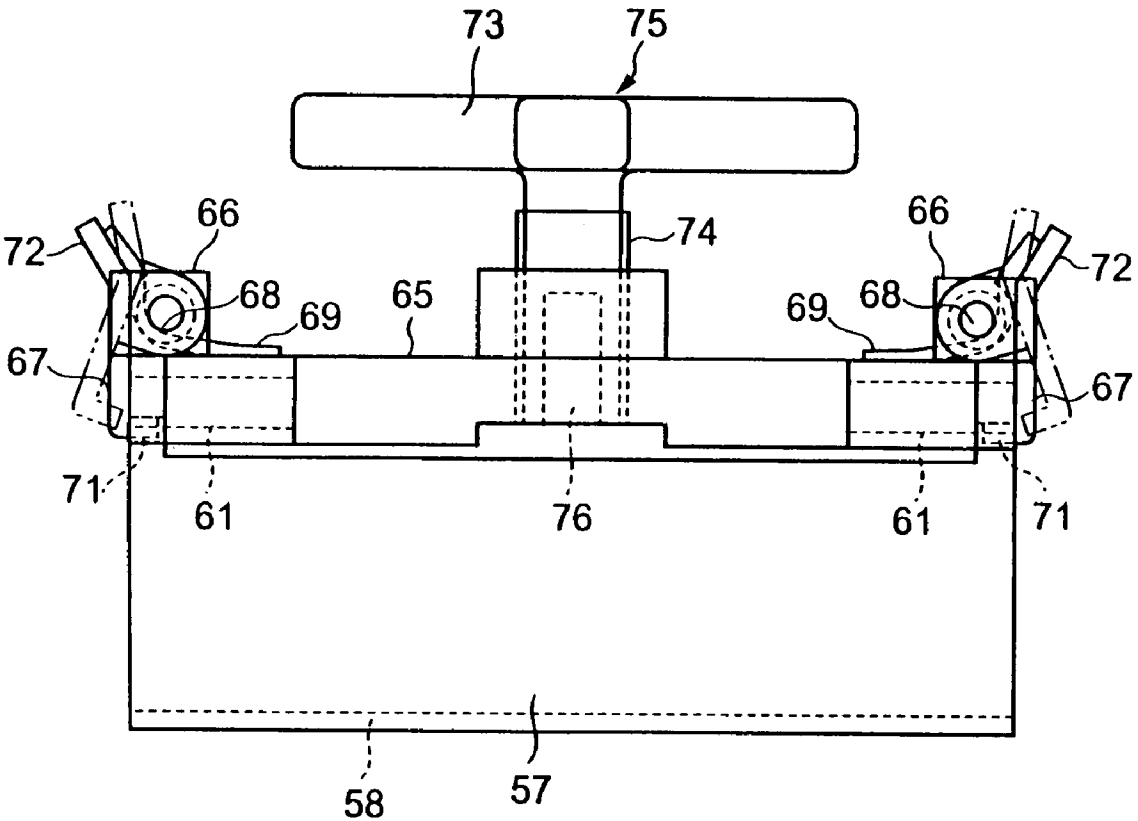

FIGS. 11A and 11B show a front view and a side view, respectively, of a second sub-assembly of the housing-remover tool having a pair of engagement members to engage with the first sub-assembly 41 of the housing-remover tool shown in FIGS. 10A to 10D and pulling means for separating the engagement member from the first sub-assembly 41.

Engagement members 57 are a pair of plate-like members opposing each other in parallel. The engagement member 57 is provided with a hook-shaped protrusion 58 extending along the bottom edge. The engagement member 57 is provided with a bearing 59 at the top edge. The bearing 59 engages with a shaft 61 on a base member 65 in such a manner that the engagement member 57 is movable between a position shown by a solid-line and a position shown by a double-dashed line. The engagement member 57 is also provided with an arm 62 which extends from the bearing 59 towards an arm 62 of the opposing engagement member 57.

Figure 12:
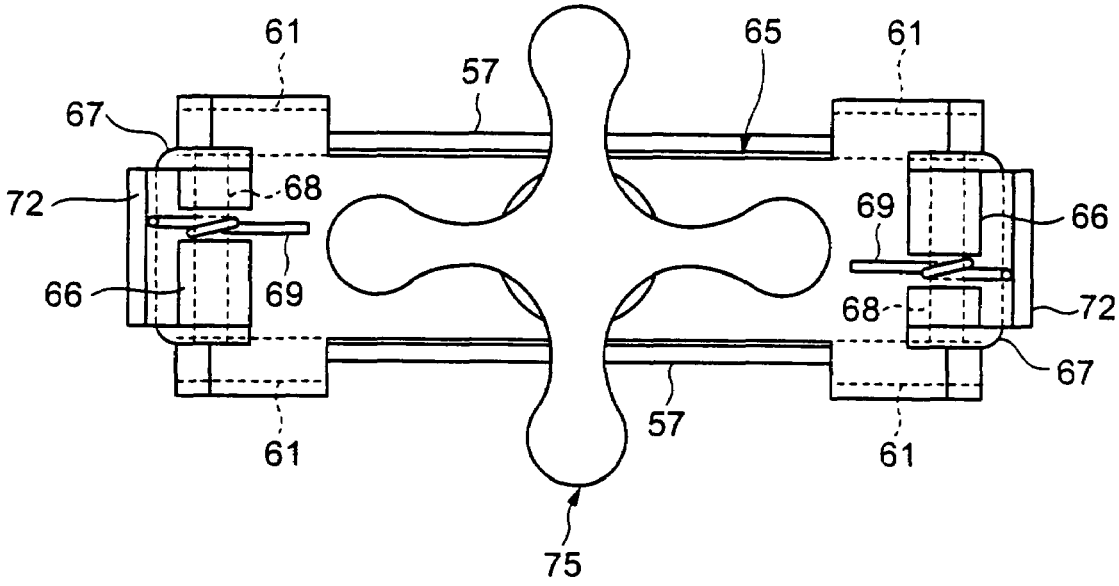
FIG. 12 is a plan view of the second sub-assembly shown in FIG. 11A.

In order to support the engagement members 57, the base member 65 is provided with a pair of parallel shafts 61 on each end portion. Protrusions 66 are provided on an upper surface of both end portions. The protrusion 66 supports a securing member 67 by the shaft 68. The securing member 67 is movable between a position shown by a double-dashed line and position shown by a solid line. As shown in FIG. 12, the securing member 67 is biased by means of a twisted coil spring 69 to the position shown by the solid line.

The lower end of the securing member 67 is bent at right angles such that a bent portion 71 enters below the arm 62 of the engagement member 57. Thus, the engagement member 57 is secured at a position shown by the solid line in FIG. 11B.

The securing member 67 is provided with a lever part 72 at the upper end. When the lever parts 72 of the pair of engagement members 67 are inclined by the fingers of the user to move against biasing forces applied by the twisted coil springs 69 towards positions shown by double-dashed lines of FIG. 11A, the bent portions 71 moves away from the arms 62. Thus, the engagement members 57 are inclined to the positions shown by the double-dashed lines. When the lever parts 72 are released, the bent portions 71 returns to positions contacting end surfaces of the arms 62 due to biasing forces applied by the twisted coil springs 68. Thus the engagement members 57 return to a state where the engagement members 57 are situated in parallel, which is shown by the solid lines.

A knob 75 is screwed into the central part of the base member 65. The knob 75 includes a cross-shaped handle 73 and a screw 74 formed integral with the central part of the cross-shaped handle 73. An opening 76 is provided at the lower central part of the screw 74.

Components such as the engagement member 57, the base member 65 and the knob 75 are fabricated from a metal material such as stainless steel.

Figure 13:
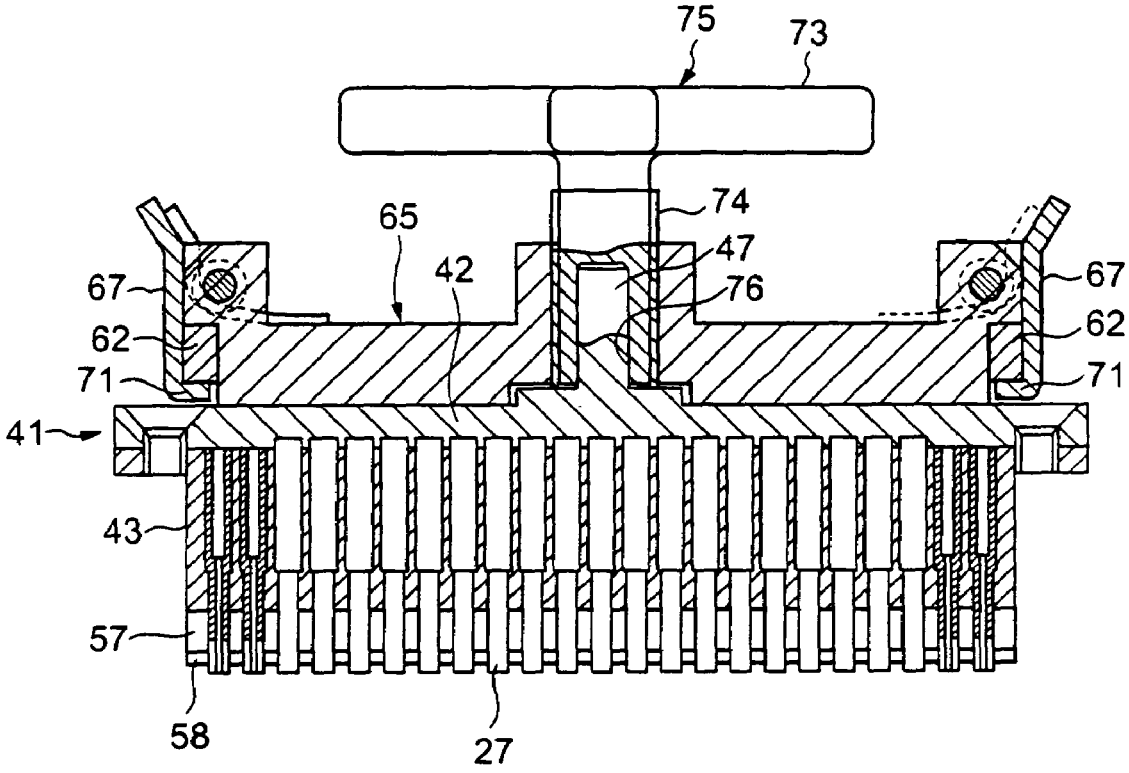
FIG. 13 is a partial cross-section front view of a housing-remover tool of the present invention.

Referring to FIGS. 13 to 19, an operation of the housing-remover tool will be described in connection with the first sub-assembly 41. FIG. 13 is a diagram showing the housing-remover tool in which the first sub-assembly 41 of the housing-remover tool with shoulder part pressers 27 of FIGS. 10A and 10B and the second sub-assembly of the housing-remover tool of FIGS. 11A and 11B being assembled.

The shaft 47 of the lid member 42 of the first sub-assembly 41 of the housing-remover tool is fitted to the opening of the knob 75. Thus the top surface of the shaft 47 is abuts an internal end surface of the opening 76 while the lower surface of the base member 65 is in contact with the upper surface of the lid member 42.

The screw 74 of the knob 75 is a right-hand screw and is threaded with a narrower pitch than a standard screw pitch. When the knob 73 is turned in right-hand direction, the screw 74 moves in a direction penetrating the base member 65. However, since the top surface of the shaft 47 is in contact with the inner end surface of the opening 76, the screw 74 does not penetrate the base member 65 but rather pulls up the base member 65 by means of the first sub-assembly 41 of the housing-remover tool. Accordingly, a gap H is formed between the lower surface of the base member 65 and the upper surface of the lid member 42. In other words, the base member 65 and the engagement members 57 attached thereto are pulled up and thus pulled apart from the first sub-assembly 41 of the housing-remover tool.

Figure 14:
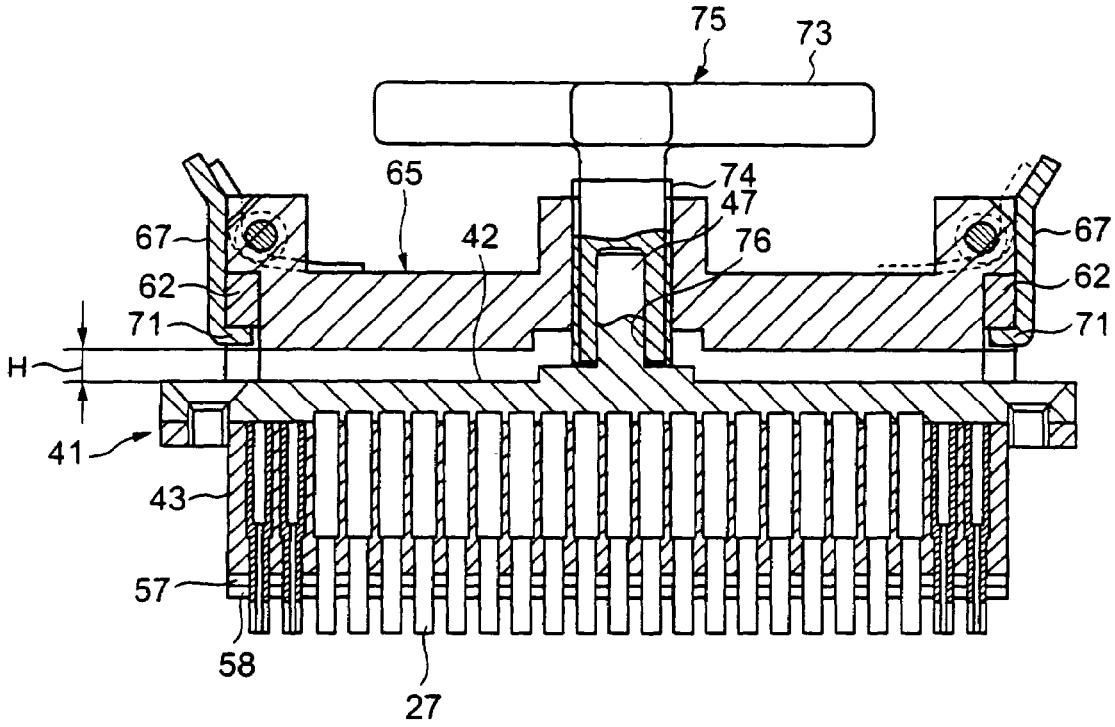
FIG. 14 is a partial cross-section front 4 view of a housing-remover tool of the present invention in a state where the engagement members are pulled up.
Figure 15:
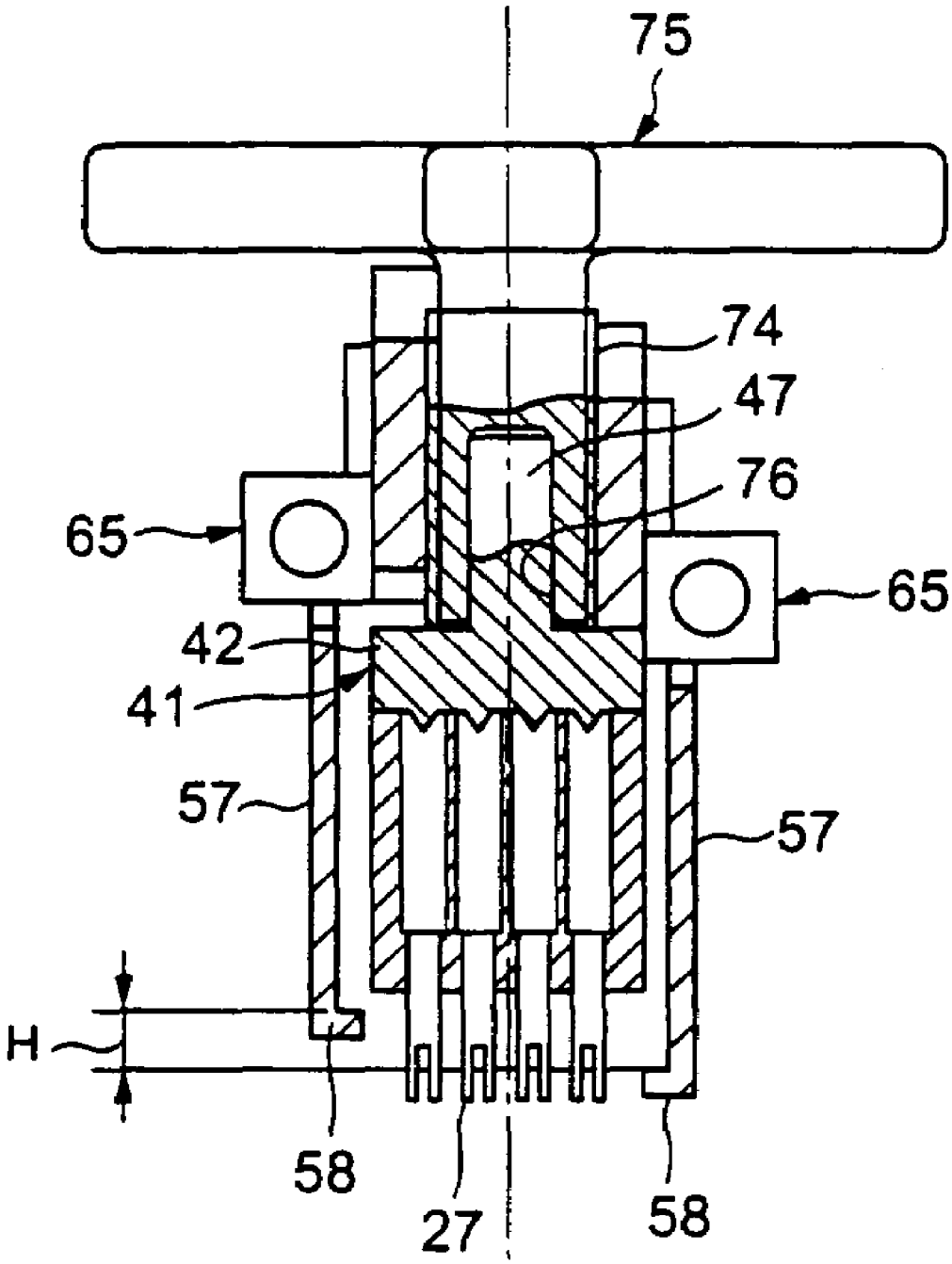
FIG. 15 is a combined view showing the state described with reference to FIG. 13 on the right-hand-side of the central line and the state described with reference to FIG. 14 on the left-hand-side of the central line.

FIG. 15 is a combined view showing the state described with reference to FIG. 13 on the right-hand-side of the central line and the state described with reference to FIG. 14 on the left-hand-side of the central line. As can be seen from the figure, the relative positional relationship between the knob 75 and the first sub-assembly 41 remains unchanged, but rather the base member 65 and thus the engaging protrusions 58 of the engagement members 57 are pulled upwards by an amount corresponding to the gap H between the lower surface of the base member 65 and the upper surface of the lid member 42.

When the knob 75 is rotated in the left-hand direction, the relative positional relationship between the first sub-assembly 41 of the housing-remover tool and the second sub-assembly of the housing-remover tool returns from the state shown on the left-hand side of the central line (the state shown in FIG. 15) to the stat shown on the right-hand side of the central line (the state shown in FIG. 13).

FIGS. 13 to 15 are used for explaining the positional relationship between the first sub-assembly 41 and second sub-assembly of the housing-remover tool. Therefore, in use, there is no structure or means for restricting to such a position relation ship, and therefore, the first sub-assembly 41 and second sub-assembly of the housing-remover tool can be easily pulled apart to those shown in FIGS. 10A–10D and FIGS. 1A–11B.

Figure 16A:
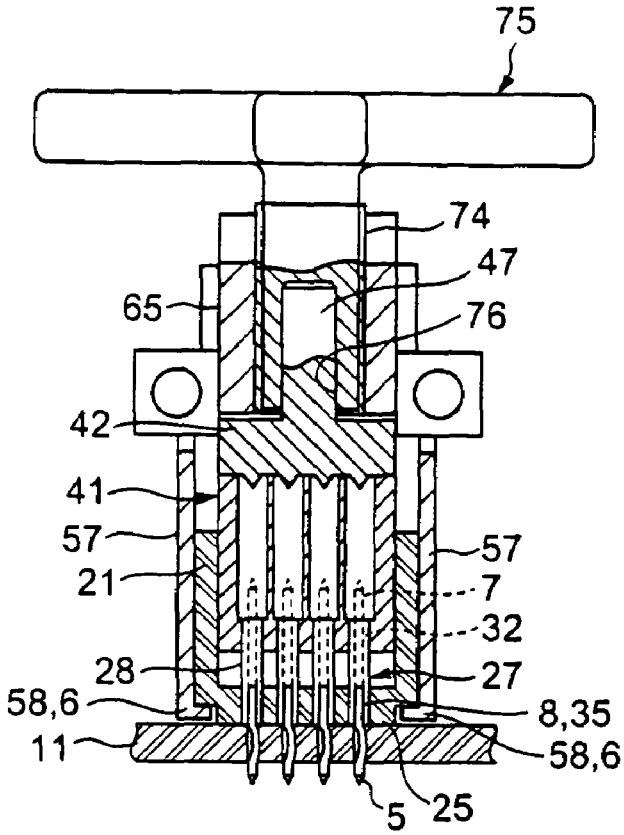
FIGS. 16A and 16B are diagrams showing a process of removing the housing of the connector using a housing-remover tool of the present invention.
Figure 16B:
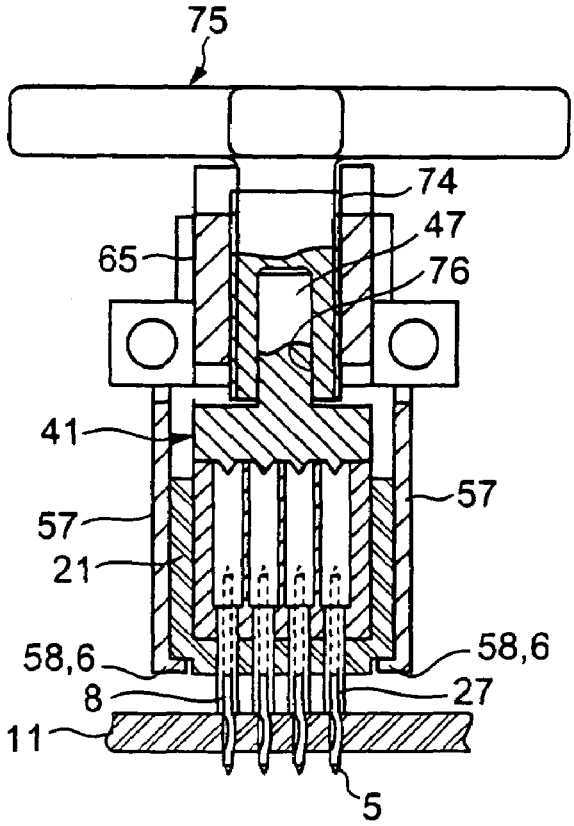

Referring to FIGS. 16A and 16B, a process of removing the housing of the connector using a housing-remover tool of the present invention will be described. As shown in FIG. 16A, firstly, the first sub-assembly 41 of the housing-remover tool described with reference to FIGS. 10A to 10D are inserted into the housing 21 of the connector connected to the circuit board 11 as shown in FIGS. 5A and 5B.

This can be achieved when the internal dimension of the housing 21 matches with the external dimension of the first sub-assembly 41 of the housing-remover tool and when the pin-type terminals 5 of the connector are provided at positions corresponding to the shoulder part pressers 27, while the pin part 7 of the pin-type terminal 5 has a diagonal size which can be inserted into a small-diameter through-hole 32 of the shoulder part presser 27.

Further, the small-diameter cylinder part 28 of the shoulder part presser 27 can be inserted into the circular through-hole 24 of the through opening 25. The cut-away part 34 at the tip of the small-diameter cylinder part 28 receives the shoulder part 8 and the tip surface is in contact with the circuit board 11. Therefore, the inner end surface of the cut-away part 34 also contacts with the end surface of the shoulder part 8. Thus, the state shown in the figure is achieved.

Then the bent portions 71 of the securing members 67 are moved to an open position shown by the double-dashed lines and thus the tip parts of the engagement members 57 are also moved to an open position shown by the double-dashed lines. Te base member 65 is moved towards the lid member 42 of the first sub-assembly 41 of the housing-remover tool and the shaft 47 is fitted into the opening 76.

When the engagement members 57 are moved to the open position, the tip parts of the bent parts 71 of the securing members 67 are pressed towards the surfaces of the arm parts 62 by a recovery force of the twisted coil spring 69. Thus the released position of the engagement members 57 is maintained even if the force exerted by the fingers of the user is released, so that the housing 41 and the pulling means can be joined without the engaging protrusions 58 of the engagement members 57 being in contact with the side surfaces of the housing 21. When the engagement members 57 are moved to a closed position, the engaging protrusions 58 are inserted under the stepped parts 6 of the housing 21 and the bent parts 71 of the securing members 67 will also be in the inserted state. Thus, the state shown in FIG. 16A, and thus the state shown in FIG. 13, is achieved.

In this state, as has been described above, when the knob 75 is rotated in the right-hand direction, the engagement members 57 are pulled up as has been described with reference to FIGS. 14 and 15. Accordingly, the housing 21 is pulled apart from the surface of the circuit board 11 as shown in FIG. 16B.

Such an operation is achieved when the engaging protrusions 58 of the engagement members 57 pulls up the housing 21. Considering the relative relationship, the knob 75 presses the first sub-assembly 41 via the shaft 47 and thus the shoulder part pressers 27 attached to the first sub-assembly 41 press the shoulder parts 8 of the pin-type terminals 5. Thus, the pin-type terminals 5 will not be pulled up with the housing 21 and thus the pin-type terminals 5 will not be pulled out from the circuit board 11.

The housing 21 can be reliably removed from the circuit board 11 in a manner described above. However, the present invention also aims for dealing with defects shown in FIG. 4. Accordingly, the shoulder part pressers 27 need not be attached to the first sub-assembly 41 at positions corresponding to defective connection pins 5.

Figure 4:
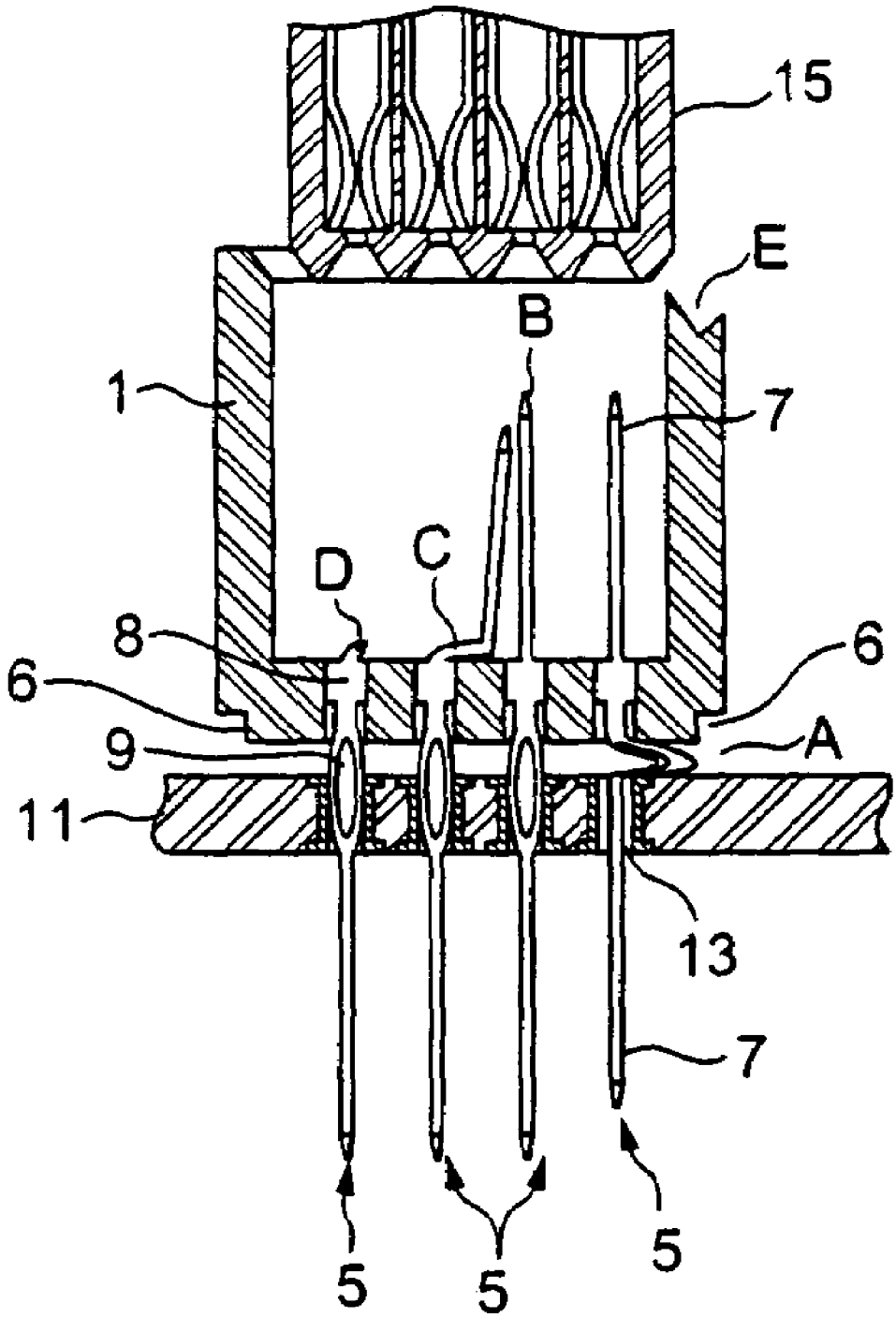
FIG.4 PRIOR ART
FIG. 4 is a schematic diagram showing various possible defects of the pin-type terminals.

With such a selective attachment of the shoulder part pressers 27, the pin-type terminal 5 shown by "A" in FIG. 4 is pulled out with the housing 21 and thus the user can remove the pin-type terminal 5. For the pin-type terminal 5 shown by "C", the pin part 7 may be cut to a state shown by "D". When the housing 21 is removed, the pin-type terminal 5 remains on the circuit board 11. Accordingly the pin-type terminal 5 can be removed from the circuit board 11 by grasping and pulling it at the shoulder part 8. This also applies for the pin-type terminal 5 shown by "D".

Figure 8:
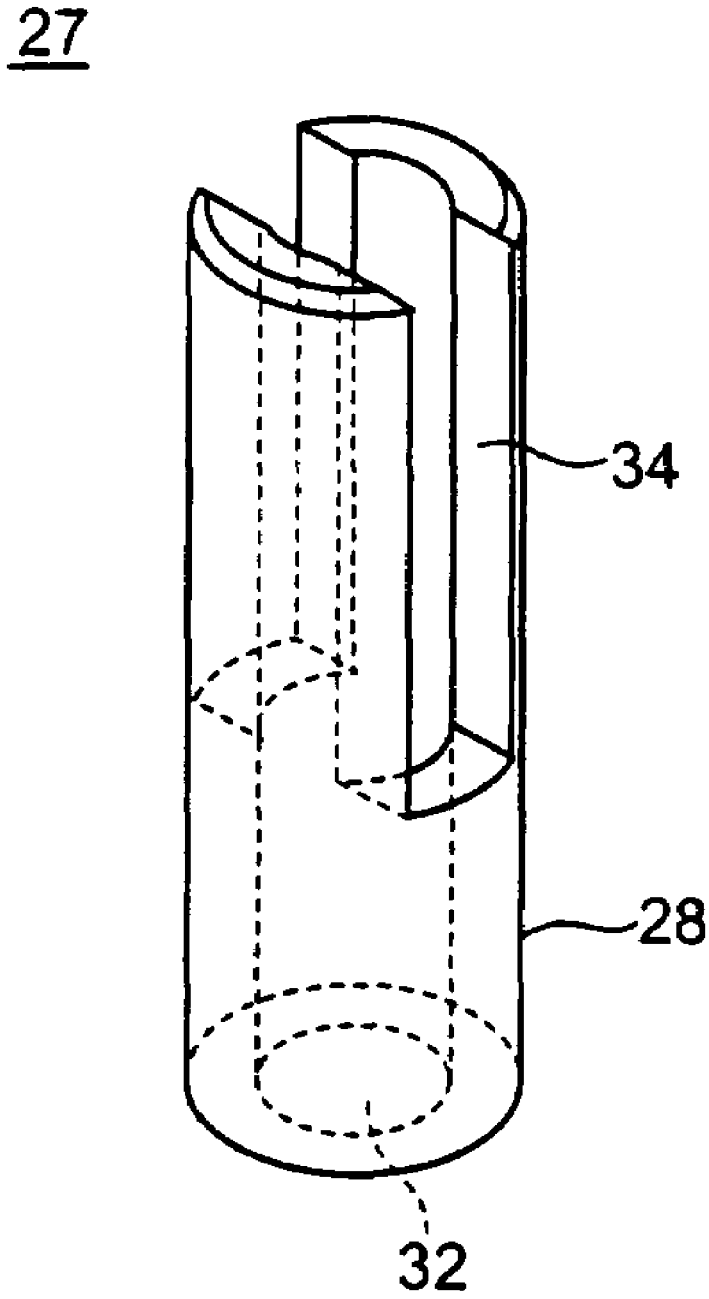
FIG. 8 is an enlarged perspective view of the leading end of the shoulder part presser shown in FIGS. 7A to 7D.

The defective pin-type terminal 5 is removed and then new pin-type terminal 5 is inserted into the through-hole 13 of the circuit board 11 with a direction of arrangement of the shoulder part 8 being matched. The new pin-type terminal 5 is inserted into the through-hole 13 of the circuit board 11 using a tubular press-in tool 81 as shown in FIG. 17A. Alternatively, the new pin-type terminal 5 is inserted by hammering the press-in tool 81 in a vertical direction. The tip part of the press-in tool 81 is configured as shown in FIG. 8. This is preferable since the press-in position is determined while the tip part is in contact with the surface of the circuit board 11. It is to be noted that the length of the press-in tool 81 is shown in a reduced scale than the actual length.

Figure 17B:
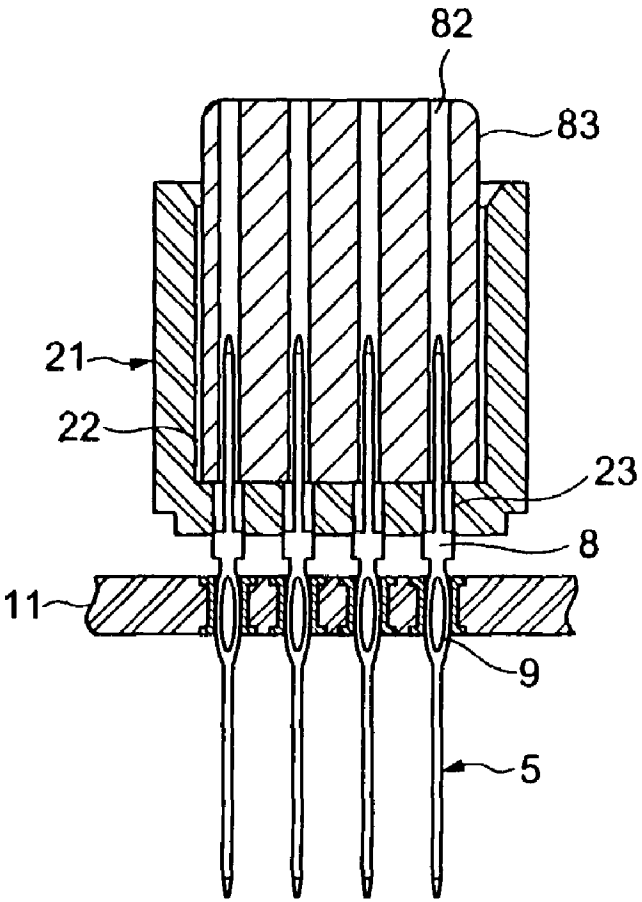
FIG. 17A is a diagram showing a tubular press-in tool and FIG. 17B is a diagram showing how the pin-type terminals are inserted into the housing of the connector.
Figure 17A:
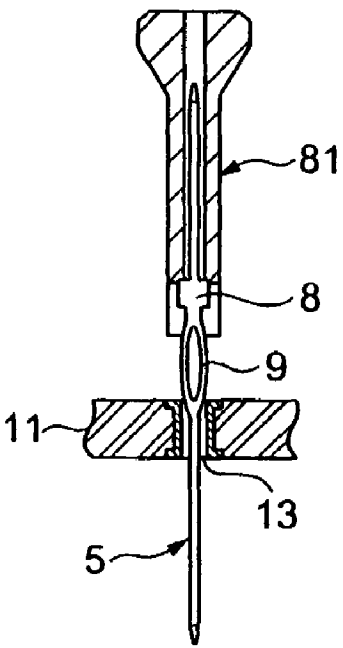
Figures 18A, 18B, 18C, 18D:
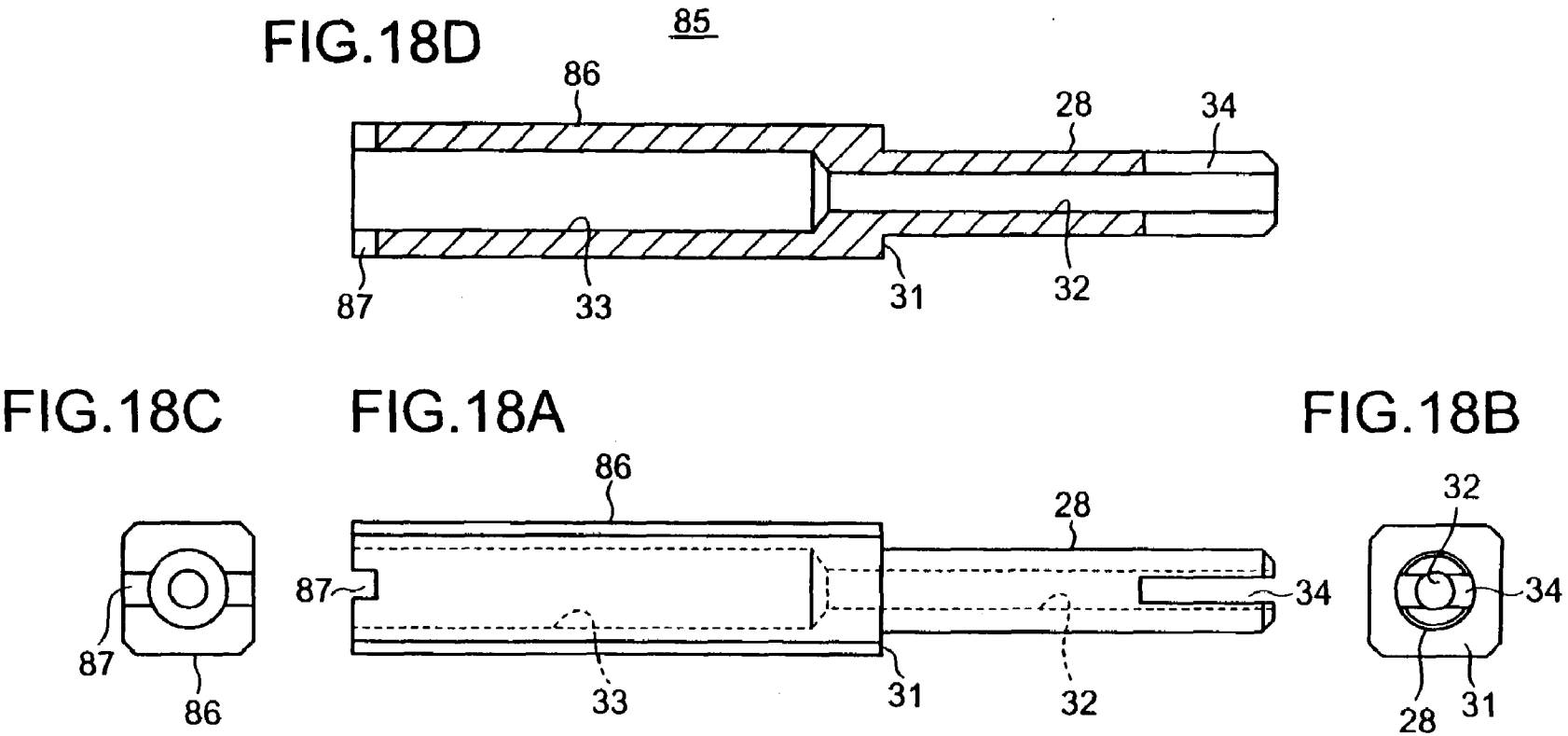
FIGS. 18A to 18D are diagrams showing a side view, a front end view, a rear end view and a cross-sectional view, respectively, of a shoulder part presser of a second embodiment of the present invention.

As shown in FIG. 17B, the pin-type terminals 5 are inserted into the housing 21 by aligning the terminal through-holes 23 of the normal housing 21 with the pin-type terminals 5. In order to achieve this in a positive manner, the entire bottom surface 22 of the housing 21 is pressed by a press-in block 83 which fits in the housing 21 and has escape holes 82 in which the pin parts 7 are fitted. It is to be noted that the shoulder parts 8 and the press-in parts 9 are shown in a 90 degrees rotated state and are shown in parallel with the plane of the figure for ease of understanding.

FIGS. 18A to 18D are diagrams showing a side view, a front end view, a rear end view and a cross-sectional view, respectively, of a shoulder part presser 85 of a second embodiment of the present invention.

The shoulder part presser 85 is provided with a small-diameter cylinder part 28 at the front end, a square cross-section part 86 at the rear end and a stepped part 31 at the boundary of the cylinder parts 28 and,29. A small-diameter hollow part 32 extending through the small-diameter cylinder part 28 and a large-diameter hollow part 33 extending through the square cross-section part 86 communicate at the center of the shoulder part presser 85. A cut-away part 34 parallel to the longitudinal direction of shoulder part presser 85 is provided at the front end and a recess 87 is provided at the rear end of the shoulder part presser 85. The cut-away part 34 and the recess 87 are cut in the same orientation.

The shoulder part presser 85 has the same structure, shape and material as those of the shoulder part presser 27 shown in FIG. 7A to 7D, except that the square cross-section part 86 is provided instead of the large-diameter cylindrical part 29 and that the recess 87 is provided instead of the v-shaped notch 35. It is to be noted that the corner parts of the square cross-section part 86 are chamfered. The length of the square cross-section part 86 is the same as the large-diameter cylindrical part 29.

Figure 19A:
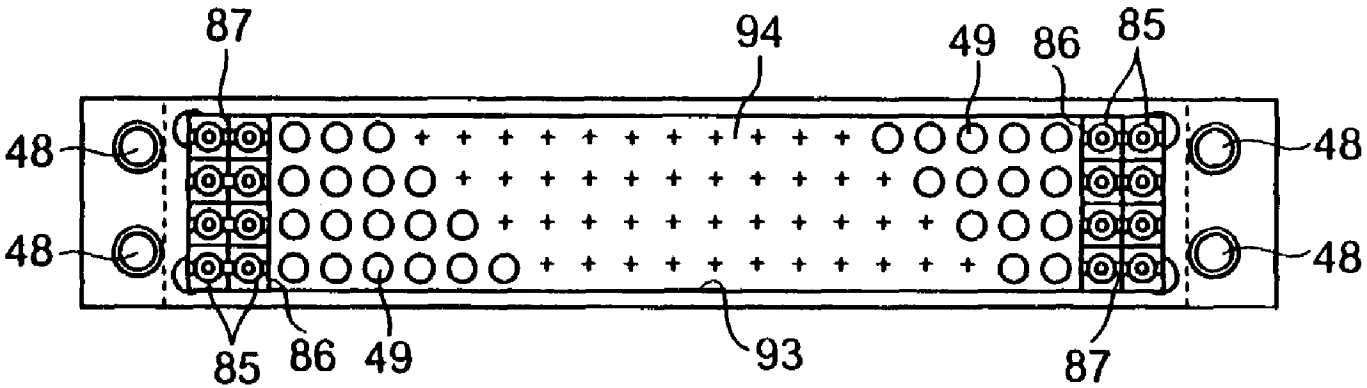
FIGS. 19A to 19C are a plan view, a cross-sectional view and a side view, respectively, of the main body of the first sub-assembly of the second embodiment of the present invention.
Figure 19B:
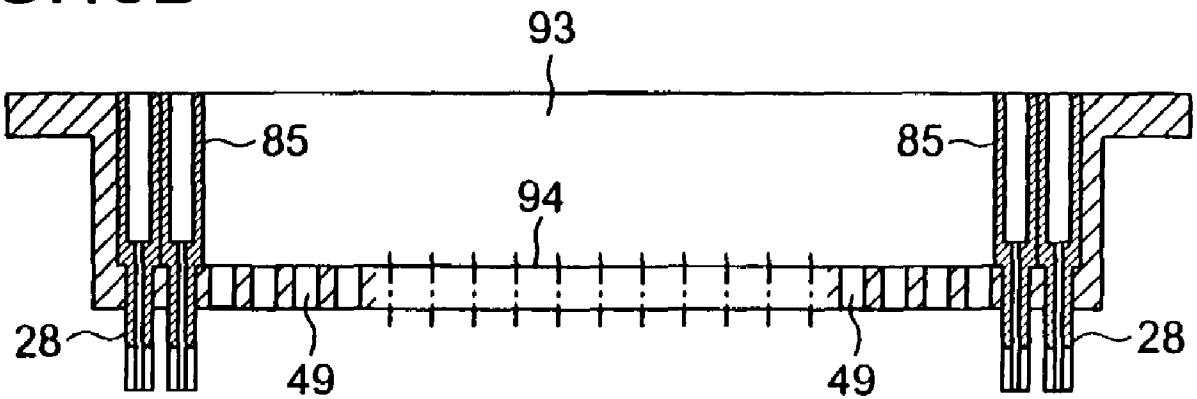
Figure 19C:
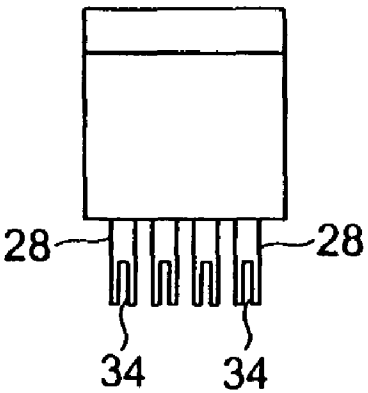

FIGS. 19A to 19C are a rear view, a cross sectional view and an end view of a main body 91 of a housing main body 91 of a second embodiment the housing-remover tool of the present invention. The main body 92 is provided with screw holes 48 at four corners, a rectangular recess 93 between the screw holes 48 and a plurality of small-diameter through-holes 49 provided at a certain interval in four rows on a bottom surface 94 of the rectangular recess 93.

The structure, the shape and the material of the main body 92 are basically the same as those of the main body 43 described with reference to FIGS. 9A to 9D, except that the rectangular recess 93 is formed instead of the large-diameter through-hole 51 and that grooves 53 having a V-shaped cross-section are not formed since the rectangular recess 93 is provided. The depth of the rectangular recess 93 is the same as that of the large-diameter through-hole 51.

Referring to FIGS. 19A and 19B, the shoulder part pressers 85 are fitted at positions corresponding to two rows inside the rectangular recess 93 of the main body 92. As can be seen in FIG. 19A, the square cross-section parts 86 are provided closely in both the row-direction and the column-direction and also provided close to the internal surface of the rectangular recess 93 of the main body 92. This implies that the size of the sides of the square cross-section part 86 matches the pitch of the small-diameter through-holes 49. The insertion position in along the axis of the shoulder part presser 85 is defined by the bottom surface 94 of the rectangular recess 93 serving as the stepped part.

Accordingly, the square cross-section part 86 may be inserted in any orientation rotated through by 90 degrees. However, it is preferable to match the orientation of the recesses 86 at the end part since the direction of the cut-away parts 34 of the small-diameter cylindrical parts 28 protruding from the main body 92 can also be matched. Though not shown in the figure, it is also possible to insert the shoulder part pressers 85 into all of the small-diameter through-holes 49 or to insert the shoulder part pressers 85 avoiding the defective pin-type terminals 5 shown in FIG. 4.

Accordingly, the state shown in FIGS. 10A to 10C can be achieved by inserting the shoulder part pressers 85 into the main body 92, attaching the lid member 42 shown in FIGS. 9A to 9D and joining the main body 92 and the lid member 42 using the countersink screws 54. The appearance of the assembled main body 92 and the lid member 42 is the same as that shown in FIGS. 10A to 10D which is an embodiment without ridges 45 and grooves 53 having a V-shaped cross-section. Accordingly, the housing 21 of the connector can be pulled in the same manner as that described with reference to FIGS. 16A and 16B. It is to be noted that the lid member 42 to be attached to the housing main body 91 has a flat surface and does not have any ridge 45.

In the above description, the housing 21 of the connector has been described to have a box shape. However, the shape of the housing 21 is not limited to a box shape can be of any shape having side surfaces extending parallel in the longitudinal direction.

The V-shaped grooves and the ridges are not limited to such particular shapes but may of any shapes such as square-shaped grooves and matching ridges.

Further, the present invention is not limited to these embodiments, and variations and modifications may be made without departing from the scope of the present invention.

The present application is based on Japanese priority application No. 2001-270966 filed on Sep. 6, 2001, the entire contents of which are hereby incorporated by reference.

What is claimed is:

1. A housing-remover tool for a press-fit connector, comprising;

shoulder part pressers for pressing shoulder parts of pin-shaped terminals, each shoulder part presser having a hollow part for receiving a pin part of a pin-shaped terminal and a cut-away part at a leading end for engaging a said shoulder part;

a first sub-assembly for insertion inside a housing of the press-fit connector and provided with through-holes for receiving said shoulder part pressers; and a second sub-assembly having a pair of engagement members having engaging protrusions which can engage with stepped parts of said housing and lifting means for lifting said engagement members along side surfaces of said first sub-assembly.

2. The housing-remover tool as claimed in claim 1, wherein said shoulder part pressers are attached to said first sub-assembly at desired positions.

3. The housing-remover tool as claimed in claim 1, wherein said each shoulder part presser is provided with a peripheral stepped part provided on its outer periphery and said through-hole of the housing is provided with an inner stepped part, so as to position said each shoulder part presser in said through-hole.

4. The housing-remover tool as claimed in claim 1, wherein said first sub-assembly comprising a lid member having ridges on its lower surface and a main body having grooves on its upper surface, orientations of said shoulder part pressers being defined when said ridges and said grooves are mated.

5. The housing-remover tool as claimed in claim 1, wherein an outer cross-section of said each shoulder part presser has a square shape so as to enable a closely located arrangement of said shoulder part pressers.

6. The housing-remover tool as claimed in claim 1, wherein said each shoulder part presser is provided with a notch or a mark at its rear end for indicating the orientation of a cut-away part provided on its leading end.

* * * * *